United States Patent [19]

Venditti

[11] Patent Number: 4,526,371

[45] Date of Patent: Jul. 2, 1985

[54] SPELLING GAME

[76] Inventor: Arthur P. Venditti, 2 Seneca Rd., Peabody, Mass. 01960

[21] Appl. No.: 474,508

[22] Filed: Mar. 11, 1983

[51] Int. Cl.[3] ..... A63F 9/00

[52] U.S. Cl. ..... 273/148 R; 235/79

[58] Field of Search ..... 273/148 R; 40/503; 235/79, 79.5, 117 A, 117 R; 434/174, 402, 124, 198, 348

[56] References Cited

U.S. PATENT DOCUMENTS

| | | | |
|---|---|---|---|
| 875,070 | 12/1907 | Haas et al. | 434/124 |
| 924,406 | 6/1909 | Walker | 434/198 X |
| 1,335,126 | 3/1920 | Mussler | 434/402 |
| 2,526,408 | 10/1950 | Posson | 235/79.5 |
| 2,621,424 | 12/1952 | Murray | 434/124 |
| 3,365,819 | 1/1968 | Connell | 434/348 |
| 3,365,820 | 1/1968 | Connell | 434/348 |
| 3,378,195 | 4/1968 | Schuh | 235/79.5 |

FOREIGN PATENT DOCUMENTS

| | | | |
|---|---|---|---|
| 548239 | 6/1956 | Belgium | 40/503 |
| 1038961 | 9/1958 | Fed. Rep. of Germany | 273/155 |

*Primary Examiner*—Anton O. Oechsle

*Attorney, Agent, or Firm*—Joseph S. Iandiorio; William E. Noonan

[57] ABSTRACT

A spelling game including a grid of randomly selected letters arranged in a columnar form on a cylindrical surface of a writing instrument, cosmetic case, cigarette lighter or similar item of a type which is normally carried or kept readily accessible by most individuals while working, traveling, attending school, or pursuing other daily activities. Rotatably and longitudinally slidable over the grid is a generally tubular cursor having a plurality of differently sized apertures, each aperture defining a window through which a group of letters may be viewed. In using the game, the cursor is moved over the grid to any one of a number of possible positions in which a group of letters is exposed through each viewing window, with as many words as possible then being spelled using the letters visible through one of these windows. The game may be played by one or more players.

22 Claims, 10 Drawing Figures

SPELLING GAME

FIELD OF INVENTION

This invention relates to games and more particularly to a spelling game involving the formation of words using any one of a number of letter groups capable of being delineated by one or more viewing windows formed in a cursor which is movable between varius positions on a columnar grid of letters provided on a cylindrical surface of a writing instrument or similar item of a type normally carried by or accessible to most individuals while they are engaged in their daily activities.

BACKGROUND OF INVENTION

The prior art is replete with various types of educational and amusement games, computing and cryptographic devices, calendars, reference and conversion devices, and similar items of manufacture, in which an indicia bearing component and a cursor or cover member are rotatable or otherwise movable relative to one another to permit viewing of or to assist in the selection or use of certain of that indicia. Many such prior art games and devices have been combined or integrated with writing instruments and other relatively small items intended to be carried and used by individuals.

U.S. Pat. Nos. 4,270,754, 3,640,531, 2,965,980 and 625,188, for example, disclose the use of a pair of relatively rotatable discs for selecting and/or viewing different groups of indicia. A grid of letter or numbers is shown as being formed on a lower disc or plate, with different groups of those letters or numbers being visible through one or more apertures in an upper cover or disc. The devices disclosed in these patents, of course, would have only one function, would be relatively large and bulky, could not be conveniently carried and used, and hence would have little appeal except possibly as parlor type games.

Illustrated in U.S. Pat. Nos. 3,365,819, 3,365,820 and 924,406 are pen and pencil cases comprised of a pair of telescopically and roratably slidable tubular members. In each device, the inner tubular member is shown as bearing a series of words, pictures, numbers and/or other indicia, and the outer tubular member is illustrated as having one or more apertures through which different portions of the indicia may be viewed as the tubular members are moved to various positions relative to one another. Although these case devices do have the capability of serving two different functions, they would still represent large and bulky products which could not be carried or used conveniently or inconspicuously, which would have little use or appeal outside of a home or classroom, and which would be of little interest or value to one desiring a spelling game.

In the cryptographic devices disclosed in U.S. Pat. Nos. 2,621,424 and 875,070, columnar letter/number grids are shown as being carried on an inner tubular member, with various groups of those letters/numbers being selectively viewable through one or more apertures formed in an outer tubular member mounted for telescopic and rotatable movement on the inner member. While these devices may suggest the use of apertures in a cursor to select indicia from a columnar grid for the purpose of forming words, they obviously do not provide for a second function, they would be too large and bulky to permit convenient and inconspicuous transportation and use, and their cursors would lack any provision for the selection of different quantities of indicia.

Writing instruments have been shown in numerous prior patents as being combined with various other devices. For instance, it has been proposed that writing instruments be provided with structure adapted for use as (i) calendars—see representative U.S. Pat. Nos. 3,531,885, 3,462,868, and 658,028;
(ii) reference devices—see representative U.S. Pat. Nos. 2,504,076, 2,262,818, and 1,859,524;
(iii) calculating and computing devices—see representative U.S. Pat. Nos. 3,738,037, 3,378,195, 2,792,992, and 2,777,636; and
(iv) other devices of little or no pertinence with respect to the present invention.

In none of these combination devices, however, is there provision for any type of spelling game or any suggestion of a columnar grid of randomly distributed letters useful in any word forming activities. A number of prior U.S. Patents (of which U.S. Pat. Nos. 2,188,232, 2,131,624, 1,361,732 and D154,035 are representative) illustrate various clip designs of the type stamped from relatively thin sheet metal and comprised of a split mounting band integral with a deflectable clip arm. The band is radially expandable to slidingly receive the cap or barrel of the writing instrument with which it is to be assembled, and generally includes two equally sized apertures for decorative, weight reduction, resiliency control or other purpose. Although clip designs of this type generally are slidable relative to the surface on which they are mounted, none have been proposed for use as cursors or as utilizing their band apertures as viewing windows.

In addition to the various patented devices discussed above, a number of spelling games have been or are now being produced and marketed. In the well-known SCRABBLE game, for example, individual letter square are picked "blind" and then arranged on a playing surface to form words. Another popular spelling game is marketed by Parker Brothers under the name BOGGLE. One version of this game involves filling a tray with dice-like cubes which display letters rather than numbers. Words are then formed with the letters which appear next to each other on the cubes. In another version of this game, a plurality of strips containing randomly distributed letters are placed in a grid, and words are then spelled using adjacent letters. While these and other similar word spelling games have proven popular over the years, they obviously are parlor type games not conveniently carried or readily used while riding in an automobile, bus, train or airplane, while sitting in a public waiting room, or under other like circumstances. Rather, they are suitable for use only in the home or in other private facilities where adequate table space, set up time, etc. are available.

SUMMARY OF THE INVENTION

The invention disclosed and claimed in this application is directed to a spelling game which may be produced and sold as a separate entity but which preferably is combined with a writing instrument, cigarette lighter, cosmetic holder, or other like product of a type normally carried and used by a great many individuals.

More particularly, it is a principal object of the present invention to provide an improved spelling game which is conveniently carried or otherwise kept readily accessible for use.

Another object of this invention is the provision of a spelling game which is combined with a writing instrument or other utilitarian item of a type normally carried or otherwise kept readily accessible for use.

Yet another objective of the present invention is to provide a new and improved game which may be played conveniently and inconspicuously by one or more players, which may be played practically any time or place, and which not only amuses but stimulates the spelling abilities of those playing it.

It still further object of this invention is the provision of a spelling game which can be combined simply and inexpensively with a writing instrument, cosmetic case, cigarette lighter or other item which normally is carried and/or used frequently by individuals and which has or can readily be provided with a cylindrical exterior surface.

Yet a still further objective of the present invention is to provide an implement in which a writing instrument and spelling game are combined, the implement including a cylindrical cap on which is printed a columnar grid of randomly selected letters and on which is slidably mounted a clip member having a split band portion acting both as a cursor for use in playing the spelling game and as a support for a clip arm to be used in securing the implement in a coat or shirt pocket.

Yet an additional object of this invention is the provision of a spelling game in which a cursor is longitudinally and rotatably slidable over a columnar grid of randomly selected letters, the cursor including a plurality of apertures of different dimensions, the apertures forming windows through which letter groups of different size may simultaneously be viewed to provide various degrees of spelling difficulty.

A still further objective of this invention is to provide a combination writing instrument and spelling game which is simple in design and construction, inexpensive to manufacture and assemble, easy to understand and simple to use, convenient to carry, reliable and efficient in function and long lasting in service.

The foregoing and additional objects and advantages of the present invention are realized in a spelling game which preferably is combined with another article of a type normally carried or kept readily accesible by a high percentage of individuals during their daily activities. A writing instrument, for example, has been found to be quite suitable for combination with the present game.

The game comprises a columnar grid of randomly selected letters arranged in circular rows or bands around a cylindrical surface, such as that provided by the cap or barrel of many present day writing instruments. Rotatably and longitudinally slidable over the grid is a tubular cursor having two or more apertures, preferably of different sizes, with each aperture defining a window through which a group of letters may be viewed for use in spelling words. If the game is combined with the cap of a writing instrument, the cursor preferably provides a radially resilient longitudinally positioned arm suitable for use in clipping the writing instrument to a coat or shirt pocket, or the like. Preferably disposed at least at one end of the cylindrical surface is a radially enlarged shoulder or like element intended to form a stop for limiting movement of the cursor to prevent its inadvertent separation from the grid.

The game may be used in various ways by one or more players. If playing alone, after indexing the cursor to a position where a group of letters is delineated through each window, the solo player may form as many words as possible using any one or more of the exposed letter groups under whatever rules he or she may arbitrarily establish. Or if two or more players are involved, after agreeing on a set of rules for letter usage and word value, each player may use a different window without moving the cursor after it has initially been positioned; each player may use the same window and letter group without moving the cursor, hiding his or her results from the other players until all have played; each player may reposition the cursor and thus use the same window but a different letter group; the players may take turns in successively forming words using the same window and letter group; or yet other playing arrangements may be used.

DISCLOSURE OF PREFERRED EMBODIMENT

Other objects, features and advantages will occur from the following description of a preferred embodiment and the accompanying drawings, in which.

Figure 1:
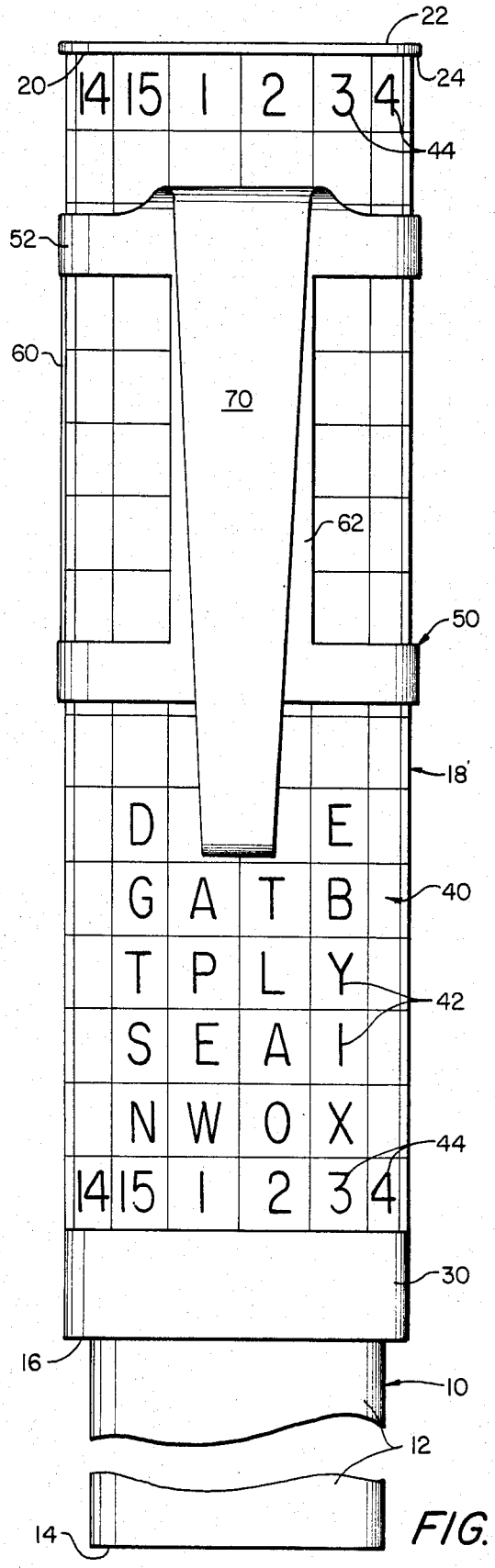
FIG. 1 is a front plan view of a writing instrument combined with a spelling game constructed in accordance with the present invention.

Referring now to FIG. 1 of the drawing, the preferred embodiment comprises an implement 10 in which a writing instrument and spelling game are combined.

The writing instrument includes an elongate generally cylindrical barrel 12 having a closed lower end 14 and an upper end (not shown) which is threaded into or otherwise removably secured within the open lower end 16 of cap 18. As will be readily understood by those in the industry, a writing unit (not shown) is disposed in barrel 12, which a writing tip projecting beyond the upper end of the barrel into the interior of cap 18. The writing tip, of course, is exposed for use upon removal of the cap 18 from barrel 12. The phrase "generally cylindrical" with respect to the barrel or surface on which the grid appears is meant to include a surface or barrel with an irregular but generally round cross-section as well as polygonal cross sections. In this case each longitudinal polygonal column may be host to a single column of letters. Further, if the cursor has a compatible polygonal shape, it may be made to index one or a group of longitudinal facet at a time about the grid.

Figure 1A:
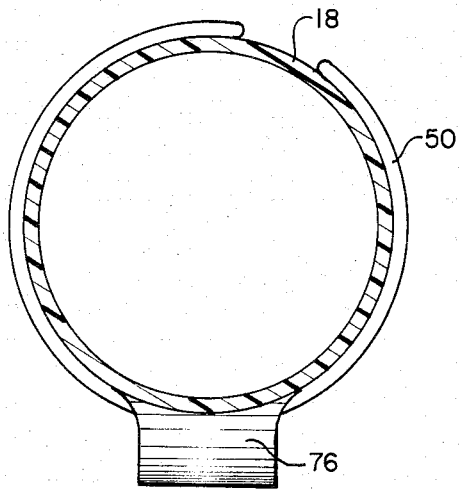
FIG. 1A is a cross-sectional view of the cap of FIG. 1.
Figure 1B:
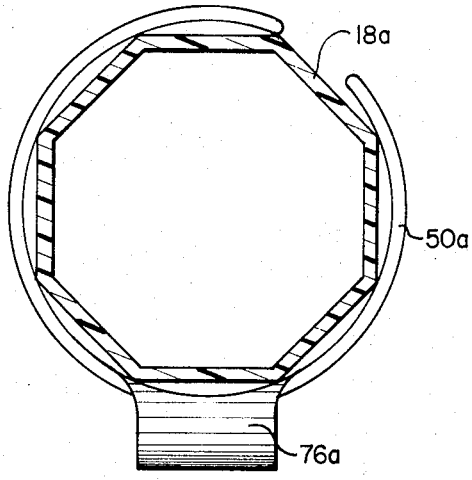
FIG. 1B is a cross-sectional view similar to FIG. 1 of a cap with a polygonal cross-section.

For example, the invention is not restricted to the strictly circular configuration of FIG. 1A: the shape or surface 18*a* on which the grid is carried may be irregular or be regular, in the nature of a polygon as shown in FIG. 1B; cursor 50*a* may be polygonal or round as shown.

Another the barrel 12 and cap 18 may be formed of other materials and by other means, those in the illustrated embodiment preferably are injection molded of a tough, break resistant and long wearing synthetic resin, such as "Cycloac", an A.B.S. (Acrylonitrile-Butadiene-Styrene) plastic, Grade T, manufactured by Borg Warner of Parkersberg, W.Va. This type of synthetic resin has been found particularly desirable, not only providing an attractive finish but being capable of readily accepting and retaining indicia as applied thereto by imprint and/or heat transfer methods.

Mounted on the upper end 20 of cap 18 is a disc 22 which is slightly larger in diameter than cap 18 to provide a forwardly facing shoulder 24. Disc 22 includes an annular collar 26 which in diameter is slightly larger than and press fitted into recess 28 in the upper end of cap 18. To insure permanent retention of collar 26 in recess 28, a small amount of a suitable adhesive preferably is applied to collar 26 before it is pressed into place.

Figure 3:
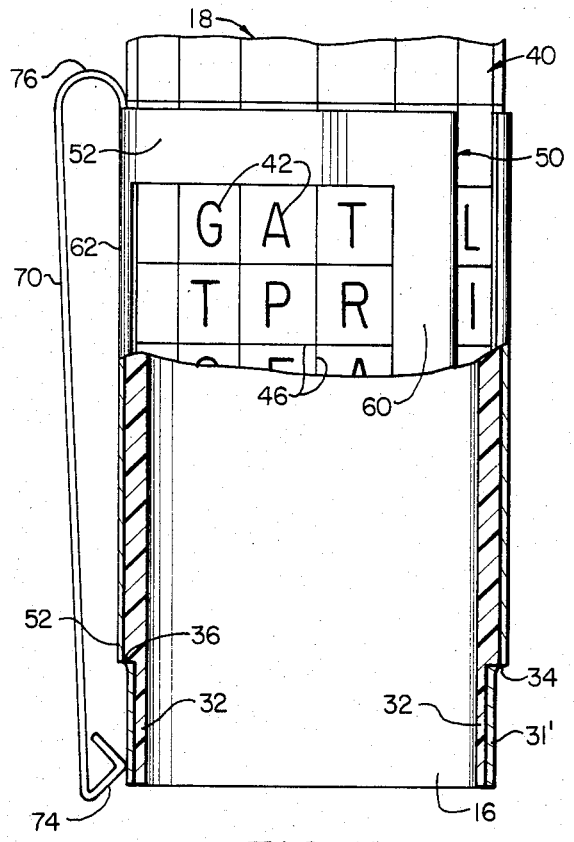
FIG. 3 is a side elevational view, partially in cross-section, of the lower end of the cap portion of the combination writing instrument-spelling game shown in FIG. 1, but with a modified cap band.

To avoid inadvertent damage to or breakage of the lower end of cap 18, a polished metal band 30 is press fitted onto a reduced section 32 (see FIG. 3) formed adjacent to the open cap end 16. The band 30 may comprise a straight tubular member as illustrated in FIG. 1 or, as illustrated in FIG. 3, the band 30' may at its upper end provide an outwardly flared lip 34, forming a rearwardly facing shoulder 36.

Figure 5:
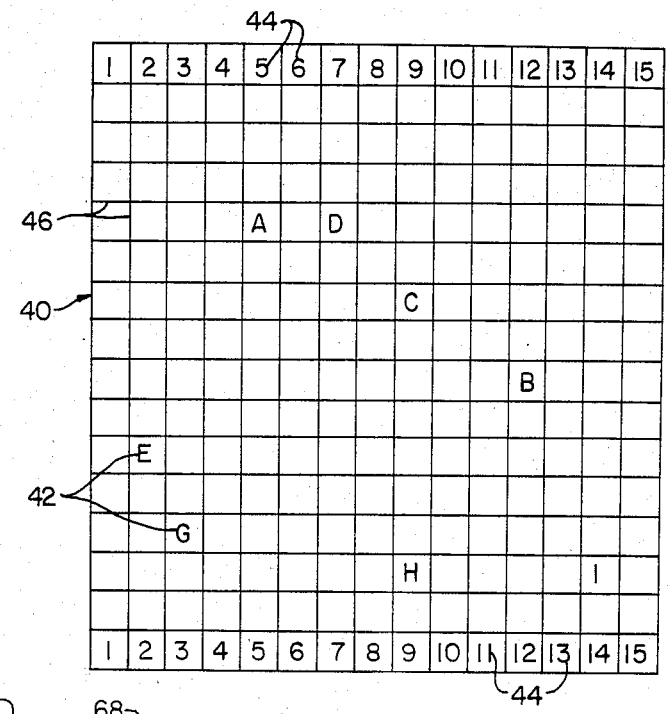
FIG. 5 is a developed plan view of the columnar letter grid as applied to or overlaid on the cap of the embodiments of FIGS. 1–3.

Overlaid on the cylindrical outer surface of cap 18 between shoulder 24 and band 30 is a columnar grid 40, consisting of letters 42, numbers 44 and grid lines 46. As best illustrated in FIG. 5, the numbers 44 run in sequence from 1 through 15 in a single circular ring at each end of the grid 40, while the letters 42 are randomly distributed throughout the balance of the grid in a series of 14 circular rings of 15 letters each. Thus, in the particular grid layout illustrated in the preferred embodiment, a total of 210 letters are provided.

As will be readily apparent, neither the total quantity or size of letters 42 nor the number of columns or circular rings in the grid 40 are critical to the accomplishment of the present invention. Depending upon the space available on the pen cap 18 or other cylindrical surface to be used, both the quantity and size of the letters 42 may be reduced or enlarged, the number or arrangement of columns and/or rings in the grid may be changed, or one or both of the rings of numbers 44 may be deleted.

Generally speaking, the letters 42 are randomly distributed throughout the grid 40. To avoid the possibility of total uselessness of certain of these letters, however, it may be desirable to deviate from the concept of pure random distribution to the extent of (i) placing a "u" adjacent to each "q"; (ii) arranging that at least one vowel is adjacent to each consonant; and (iii) keeping the ratio or frequency of occurrence of the letters approximately equal to the ratio or frequency with which the various letters occur in normal speech or written work.

While grid 40 may be formed on cap 18 as molded-in or hot stamped indents which are subsequently filled with a colorant material, such procedures are not preferred because they tend to leave the cap surface somewhat rough. Rather, the grid preferably is overlaid on the smooth cylindrical surface of the cap 18 by a heat transfer process which avoids any indents in the cap surface. This may be accomplished by rolling the cap 18 against a foil coated with a heat sensitive ink and backed by a heated silicone roller or other die arrangement which carries a reverse image of the grid 40. The ink heated by the reverse grid image is thus softened and transferred from the foil to the cap 18 to provide the finished grid 40. Or a reverse image of the grid 40 may be printed on a foil in heat sensitive ink, which image is then transferred to the cap 18 as the cap 18 is rolled against the foil while the foil is supported by a heated roller or like element.

After the grid 40 has been applied to cap 18, it preferably is protected by several coats of a suitable clear lacquer. A lacquer found suitable for use with the A.B.S. resin used in molding cap 18 and the heat sensitive transfer ink in grid 40 is available from Walter Wurdock Inc., 4977 Fyler Avenue, St. Louis, Mo. 63139, identified as production No. A-279-5. To provide the wear resistance believed desirable in the preferred embodiment of this invention, five coats of the specified lacquer have been found appropriate.

Figure 6:
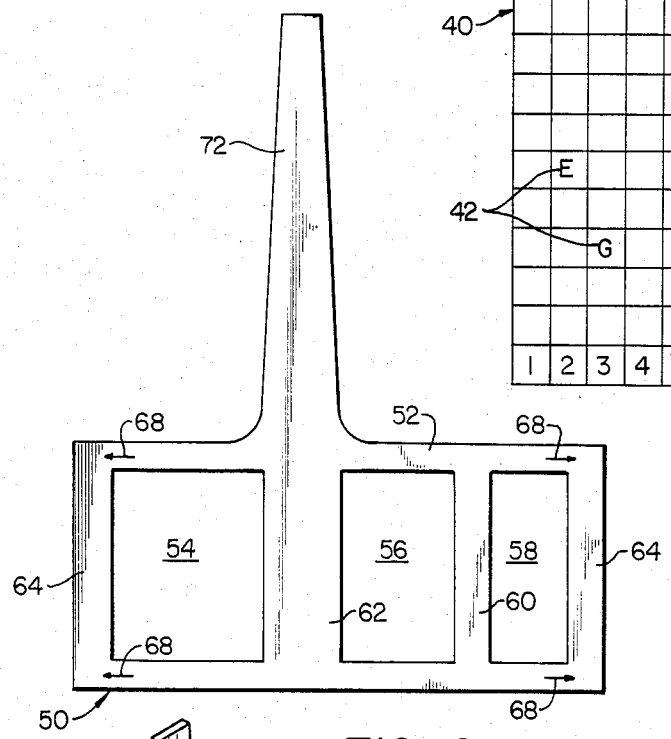
FIG. 6 is a developed plan view of the cursor of the embodiments of FIGS. 1–3.
Figure 7:
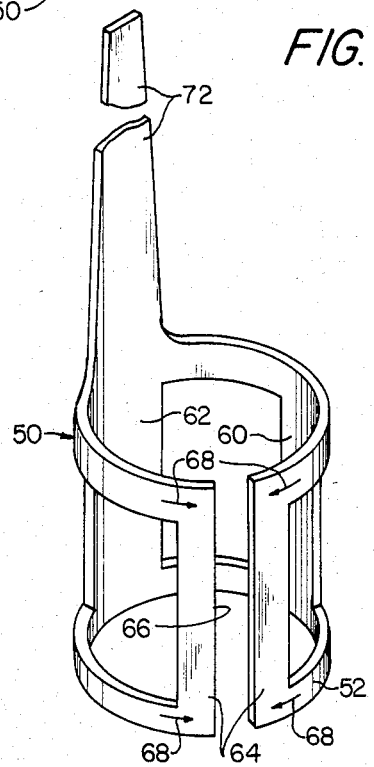
FIG. 7 is a perspective view of the cursor of FIG. 6, showing the body portion thereof formed into a generally tubular shape.
Figure 8:
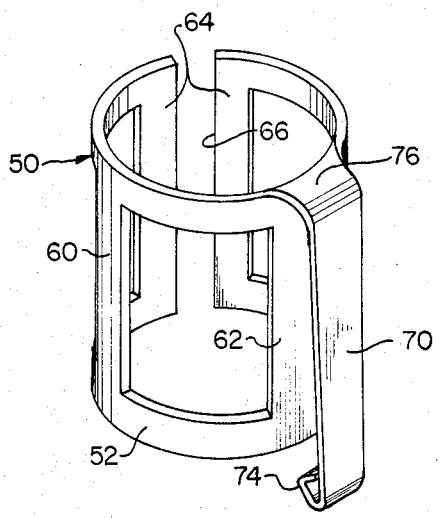
FIG. 8 is a perspective view of the cursor of FIG. 6, showing both the body and arm portions of the cursor of FIG. 6, formed and finished for use in accordance with the embodiment of FIG. 1.

Slidably mounted on cap 18 is a combination cursor-clip member 50, the details of which are best shown in FIGS. 6, 7 and 8. This member preferably is stamped from a relatively thin resilient steel sheet material which after being deburred, formed and cleaned preferably is plated with nickel, chrome, or the like, or otherwise coated to protect the steel against corrosion.

Referring particularly to FIG. 6, the member 50 includes a generally rectangular body or band portion 52 comprising a cursor containing a plurality of apertures 54, 56 and 58. These apertures preferably are; (i) rectangular in shape; (ii) of a height equal to that of five squares in grid 40; (iii) varied in width, aperture 54 being equal in width to that of two squares in grid 40, aperture 56 being equal in width to that of three such squares, and aperture 58 being equal in width to that of four such squares; (iv) separated by a webb 60 equal in width to that of one square of grid 40, and a webb 62 equal of two such squares.

The purpose of so dimensioning the apertures 54, 56 and 58 and webbs 60 and 62 is to insure that none of the letters 42 of grid 40 are partially hidden or cut off after the cursor 52 has been positioned for use in playing a spelling game. It will also be understood that there is nothing critical about the specific number and/or dimensions of the apertures in band 52, as fewer or more than three could be provided, and their height and/or width could differ from the five "square" height and two, three and four "square" widths described above.

Referring now to FIGS. 7 and 8, it will be seen that two basic forming operations are required in order to prepare the flat "blank" of FIG. 6 for use. The first operation consists of rolling or otherwise forming the band portion 52 into a tubular configuration, with its outer ends 64 spaced a short distance apart. The formed band 52 should be somewhat smaller in inside diameter than the outside diameter of cap 18 to provide a frictional fit between the band 52 and grid 40 after assembly of the member 50 and cap 18. As will be apparent, such a frictional fit is necessary to avoid inadvertent movement of the band 52 on the relatively smooth surface of the lacquered grid 40.

In addition to the three apertures formed in band 52, a fourth aperture 66 is provided between the outer ends 64 of the band 52 after its assembly onto grid 40. Preferably, the outer ends 64 are dimensioned such that when the band 52 is in a distended condition on grid 40, they are spaced apart the width of one of the grid squares. Thus, the opening between the ends 64 may be considered and used as a fourth aperture when the band 52 is employed as a cursor. Accordingly, in playing a spelling game using the band 52 as hereinabove described, the players may choose an aperture which displays one, two, three or four columns of letters.

As shown in FIG. 7, the outer ends 64 of band 52 are provided with oppositely facing arrow indents 68 spaced quite close to their upper and lower edges. These arrows are provided particularly for use with the rows of numbers 44 of grid 40 in moving the cursor 52 to a specific or designated position on the grid 40.

Calling attention now to FIG. 8, the second basic forming operation on member 50 involves completion of the clip arm 70 from the tongue-like element 72 which initially projects outwardly of band 52 in alignment with webb 62. In one step of this operation, the outer end of element 72 is formed back upon itself to provide a generally triangularly shaped contact ball 74. In another operation, the element 72 is formed at its upper end to provide a semi-circular bight portion 76 resiliently connecting band 52 and clip arm 70. As will be noted particularly from FIG. 3, the arm extends from the bight portion 76 forwardly along webb 62 to position the ball 74 forwardly of the lower edge of band 52. Thus, when the clip cursor member 50 is positioned at or near the upper end of cap 18 as illustrated, for example, in FIG. 1, the ball 74 of clip arm 70 will squeeze between itself and cap 18 the fabric of the coat or shirt pocket in which the implement 10 may be placed between uses.

If the game of this invention should be combined with a lipstick container or other product not normally carried clipped to a coat or shirt pocket, the clip arm 70 would not be necessary and preferably should not be provided. The cursor 52 only would be adequate under such circumstances.

The cursor-clip member 50 is readily assembled with cap 18 by springing band 52 outwardly to increase its inside diameter and then sliding it over the lower end 16 of cap 18, with the clip arm 70 positioned away from the closed cap end 20. Upon release of the outward pressure from band 52, the cursor-clip may then be rotated and/or moved longitudinally over grid 40 to any of a multiplicity of positions in which various groups of letters 42 are delineated by the different apertures 54, 56, 58 and 66 which thus form viewing windows for the letter groups. The letters in the viewing windows may then be used to spell words under such rules as may be determined in advance by the individual or individuals playing the game.

As best illustrated in FIG. 3, the upper edge of band 52 will abut forwardly facing shoulder 24 upon movement of the clip-cursor member 50 the upper end of grid 40. Shoulder 24 thus comprises a means for limiting upward movement of the clip-cursor 50 not only to prevent inadvertent loss of the clip-cursor 50 over the upper end 20 of cap 18 but to automatically position the upper set of index arrows 68 on the upper number ring 44 for convenient reference purposes. Should it be felt necessary also to limit downward movement of the clip-cursor 50 on grid 40, lower stop means may conveniently be provided by use of the band 30' described previously as having a flared upper edge 34 which forms an upwardly facing shoulder 36. As illustrated in FIG. 3, the lower edge of band 52 will abut shoulder 36 to prevent inadvertent loss of the clip-cursor 50 over the lower end 16 of cap 18 and to automatically position the lower set of index arrows 68 on the lower number ring 44. Band 52 may be flexed outwardly to increase its inside diameter sufficiently to slide over shoulder 24 or 36. Otherwise, the clip-cursor member 50 will be securely retained on yet easily slidable over grid 40.

Figure 4:
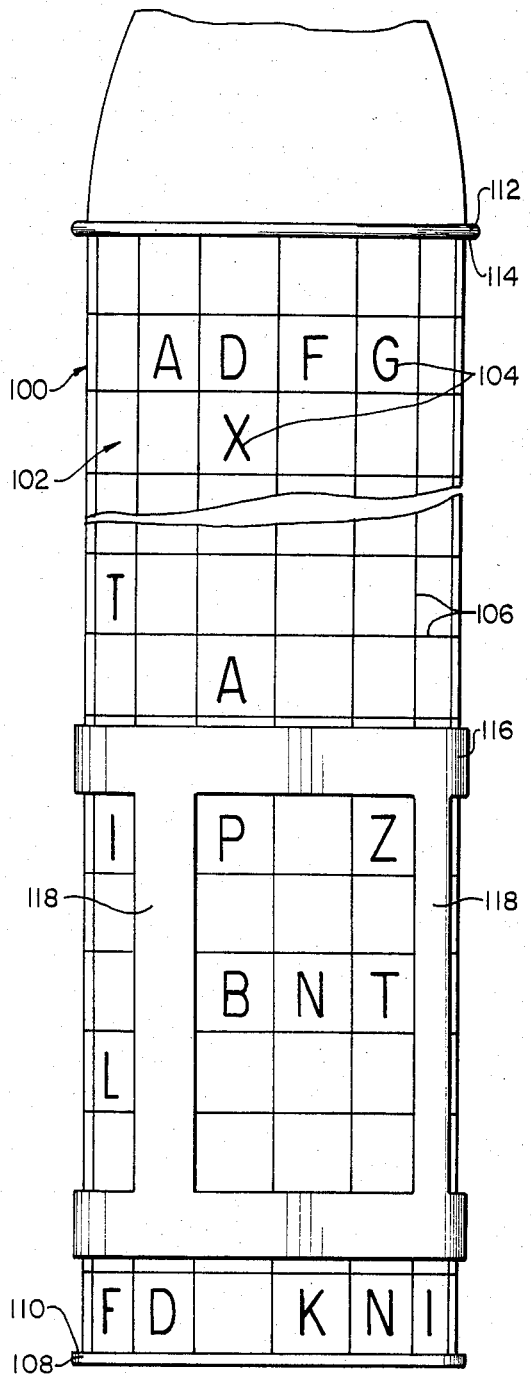
FIG. 4 is a plan view of a writing instrument barrel combined with a spelling game constructed in accordance with the present invention.

Calling attention now to FIG. 4, there is disclosed a cylindrical writing instrument barrel 100 bearing a columnar grid 102 consisting of a plurality of rings of letters 104 separated by grid lines 106. In this embodiment, the grid does not include any number rings but rather consists solely of letters.

The grid 102 preferably is applied to barrel 100 and protected by a lacquer coating, all as described in detail hereinabove in connection with the embodiment of FIG. 1–3.

Stop means are provided at the upper and lower ends of grid 102. The stop at the lower end of the barrel 100 consists of an enlarged disc 108 providing an upwardly facing shoulder 110. And at the upper end of the grid 102, the stop means comprise a plastic or metallic ring 112 inset into but extending slightly beyond the surface of barrel 100 to provide a rearwardly facing shoulder 114.

Rotatably and longitudinally slidable on grid 102 between shoulders 110 and 114 is a cursor 116 having a plurality of apertures 118 sized to form windows through which groups of letters 104 may be viewed for use in spelling words. The cursor 116 preferably is stamped from a thin resilient sheet steel, deburred, rolled into tubular form, plated or coated, and otherwise finished and placed on barrel 100 in substantially the same manner as that described above with respect to the cursor-clip member 50 of the embodiment of FIGS. 1–3.

It will be appreciated, of course, that cursor 116 does not include a clip arm 70 as the barrel 100 normally would be used with a cap member (not shown) having a conventionally mounted pocket clip.

Figure 2:
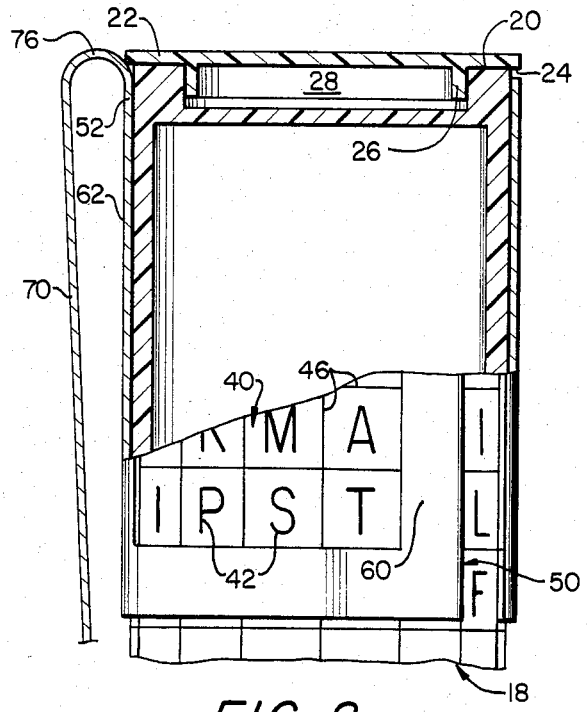
FIG. 2 is a side elevational view, partially in cross-section, of the upper end of the cap portion of the combination writing instrument-spelling game shown in FIG. 1.

The embodiment of FIG. 4 would be used in the same manner as the embodiment of FIGS. 1–3 in playing various spelling games: the cursor 116 is movable between a multiplicity of positions on grid 102 to delineate through apertures 118 various openings of letters 104 for use in spelling words.

From the foregoing specification, it will be appreciated that the game device of the present invention is not limited to use on writing instruments but may be combined with other types of products or even used alone. Further, it will be understood that the structural and/or functional details disclosed in this application are not intended to be limiting, but are illustrative only, as many modifications may be made therein without departing from the spirit, scope or principles of the present invention.

Other embodiments will occur to those skilled in the art and are within the following claims:

What is claimed is:

1. A spelling word game comprising:

a generally cylindrical surface;

a columnar grid of letters arranged in circular rows about said cylindrical surface;

a tubular cursor rotatably and axially slidable along and around said cylindrical surface; and a number of apertures of different sizes in said cursor for defining windows through which may be viewed groups of letters selected by the positioning of said cursor on said surface.

2. The spelling word game of claim 1 in which said cylindrical surface includes a stop at one end for limiting axial movement of said cursor.

3. The spelling word game of claim 1 in which said cylindrical surface includes a stop at each end for limiting axial movement of said cursor.

4. The spelling word game of claim 1 in which said tubular cursor is made of resilient material.

5. The spelling word game of claim 1 in which said tubular cursor includes a longitudinal slot which functions as a window for viewing a group of letters.

6. The spelling word game of claim 1 in which said tubular cursor includes a mounting clip.

7. A spelling word game mounted on a writing instrument comprising:

a generally cylindrical surface on said writing instrument;

a columnar grid of letters arranged in circular rows about said cylindrical surface;

a tubular cursor rotatably and axially slidable along and around said cylindrical surface; and a number of apertures of different sizes in said cursor for defining windows through which may be viewed groups of letters selected by the positioning of said cursor on said surface.

8. The spelling word game of claim 7 in which said cylindrical surface includes a stop at one end for limiting axial movement of said cursor.

9. The spelling word game of claim 7 in which said cylindrical surface includes a stop at each end for limiting axial movement of said cursor.

10. The spelling word game of claim 7 in which said tubular cursor is made of resilient material.

11. The spelling word game of claim 7 in which said tubular cursor includes a longitudinal slot which functions as a window for viewing a group of letters.

12. The spelling word game of claim 7 in which said tubular cursor includes a mounting clip.

13. A spelling word game comprising:

a generally cylindrical surface;

a columnar grid of letters arranged in a plurality of generally even circular rows of side-by-side letters about said cylindrical surface; and a tubular cursor rotatably and axially slidable along and around said cylindrical surface, said tubular cursor including at least one longitudinal slot which functions as a window for viewing a group of letters.

14. The spelling word game of claim 13 in which said cylindrical surface includes a stop at one end for limiting axial movement of said cursor.

15. The spelling word game of claim 13 in which said cylindrical surface includes a stop at each end for limiting axial movement of said cursor.

16. The spelling word game of claim 13 in which said tubular cursor is made of resilient material.

17. The spelling word game of claim 13 in which said tubular cursor includes a mounting clip.

18. A spelling word game mounted on a writing instrument comprising:

a generally cylindrical surface on said writing instrument;

a columnar grid of letters arranged in a plurality of generally even circular rows of side-by-side letters about said cylindrical surface;

a tubular cursor rotatably and axially slidable along and around said cylindrical surface and including at least one longitudinal slot which functions as a window for viewing a group of letters.

19. The spelling word game of claim 18 in which said cylindrical surface includes a stop at one end for limiting axial movement of said cursor.

20. The spelling word game of claim 18 in which said cylindrical surface includes a stop at each end for limiting axial movement of said cursor.

21. The spelling word game of claim 18 in which said tubular cursor is made of resilient material.

22. The spelling word game of claim 18 in which said tubular cursor includes a mounting clip.

* * * * *